US005421494A

United States Patent [19]

Kolton et al.

[11] Patent Number: 5,421,494

[45] Date of Patent: Jun. 6, 1995

[54] HANGER COMPOSITE FOR DISPLAY OF PLURAL ARTICLES INCLUDING A BELT AND A WATCH

[75] Inventors: Chester Kolton, Westfield, N.J.; Stuart S. Spater, Livingston, N.J.

[73] Assignee: B&G Plastics, Inc., Newark, N.J.

[21] Appl. No.: 180,045

[22] Filed: Jan. 11, 1994

[51] Int. Cl.[6] ..... A47G 25/14; A47G 25/18

[52] U.S. Cl. ..... 223/85; 223/87; 223/88; 206/301

[58] Field of Search ..... 223/85, 87, 88, DIG. 1, 223/DIG. 4; D6/328; 224/252, 253; 2/312, 314, 319; 206/301

[56] References Cited

U.S. PATENT DOCUMENTS

| | | | |
|---|---|---|---|
| 1,510,915 | 10/1924 | Bartholdi | 223/87 |
| 2,391,661 | 12/1945 | Watkins et al. | 223/88 |
| 4,416,401 | 11/1983 | King | 223/88 |
| 4,453,655 | 6/1984 | Smilow et al. | 223/87 |
| 5,029,739 | 7/1991 | Blanchard et al. | 223/88 |
| 5,222,638 | 6/1993 | Kolton et al. | 223/87 |

*Primary Examiner*—Clifford D. Crowder
*Assistant Examiner*—Bibhu Mohanty
*Attorney, Agent, or Firm*—Robin, Blecker, Daley & Driscoll

[57] ABSTRACT

A hanger composite include, a first hanger having a hook portion for releasable securement to a display rod and an elongate foldable tail portion, the tail portion defining a latching opening therethrough and a projection extending outwardly of the tail portion to a given extent for latching disposition in the latching opening, and a second hanger assembled with the first hanger and defining a compartment for containment of an article, the second hanger having an opening therethrough configured complementally with the tail portion of the first hanger and enabling the assembly of the first and second hangers.

15 Claims, 3 Drawing Sheets

HANGER COMPOSITE FOR DISPLAY OF PLURAL ARTICLES INCLUDING A BELT AND A WATCH

FIELD OF THE INVENTION

This invention relates generally to hangers for article display and pertains more particularly to a hanger composite for display of such as a belt along with an article to be marketed therewith.

BACKGROUND OF THE INVENTION

Folding tail belt hangers are depicted in U.S. Pat. Nos. 3,710,996 and 4,063,669, to which incorporating reference is made. The former patent discloses a hanger for the hanging of belts having buckles with prongs. The latter patent, while specific to the further disclosure of the hanging of belts having buckles with studs, shows both belt hanging facilities. FIGS. 1 and 2 depict a hanger in accordance with the latter patent.

SUMMARY OF THE INVENTION

Whereas the known folding tail hangers have heretofore had use only in the hanging of belts, applicants' objective in the subject invention is to expand the facilities of such hangers.

More particularly, applicants look herein to the use of the known hangers for the display also of an article used, e.g., promotionally, in the sale of a belt.

In attaining these and other objects, applicants provide a hanger composite including a first hanger having a hook portion for releasable securement to a display rod and an elongate foldable tail portion, the tail portion defining a latching opening therethrough and a projection extending outwardly of the tail portion to a given extent for latching disposition in the latching opening, and a second hanger assembled with the first hanger and defining a compartment for containment of an article, the second hanger having an opening therethrough configured complementally with the tail portion of the first hanger and enabling the assembly of the first and second hangers.

The first hanger defines a belt buckle prong receiving opening in the tail portion, the tail portion preferably being configured to dispose the second hanger distal from the belt buckle prong receiving opening. The second hanger desirably defines a fold line aside the second hanger opening, whereby the second hanger may be adjusted such that the belt and the second hanger are disposed in vertically parallel manner.

More particularly, the invention provides a hanger composite including first and second hangers, the first hanger having a hook portion for releasable securement to a display rod and an elongate foldable tail portion of a given transverse dimension. The tail portion defines a latching opening therethrough and a projection extending outwardly of the tail portion to a given extent for latching disposition in the latching opening. The second hanger is of transverse dimension exceeding the given transverse dimension of the first hanger and defines an aperture therein having a first part of dimension corresponding with the given transverse dimension of the tail portion and a second part contiguous with the first part and being of dimension corresponding with the given extent of the projection of the tail portion.

Accordingly, the second hanger can be assembled with the first hanger by passage of the first hanger tail portion through the second hanger aperture and by then folding the tail portion and placing its projection in the latching opening thereof. The first hanger is adapted for hanging a belt and the second hanger includes a compartment for display of an article to be conveyed with sale of the belt.

The foregoing and other objects and features of the invention will be further evident from the following detailed description of preferred embodiments thereof and from the drawings in which like components are identified by like reference numerals throughout.

DETAILED DESCRIPTION OF PREFERRED EMBODIMENTS AND PRACTICES

Figure 3:
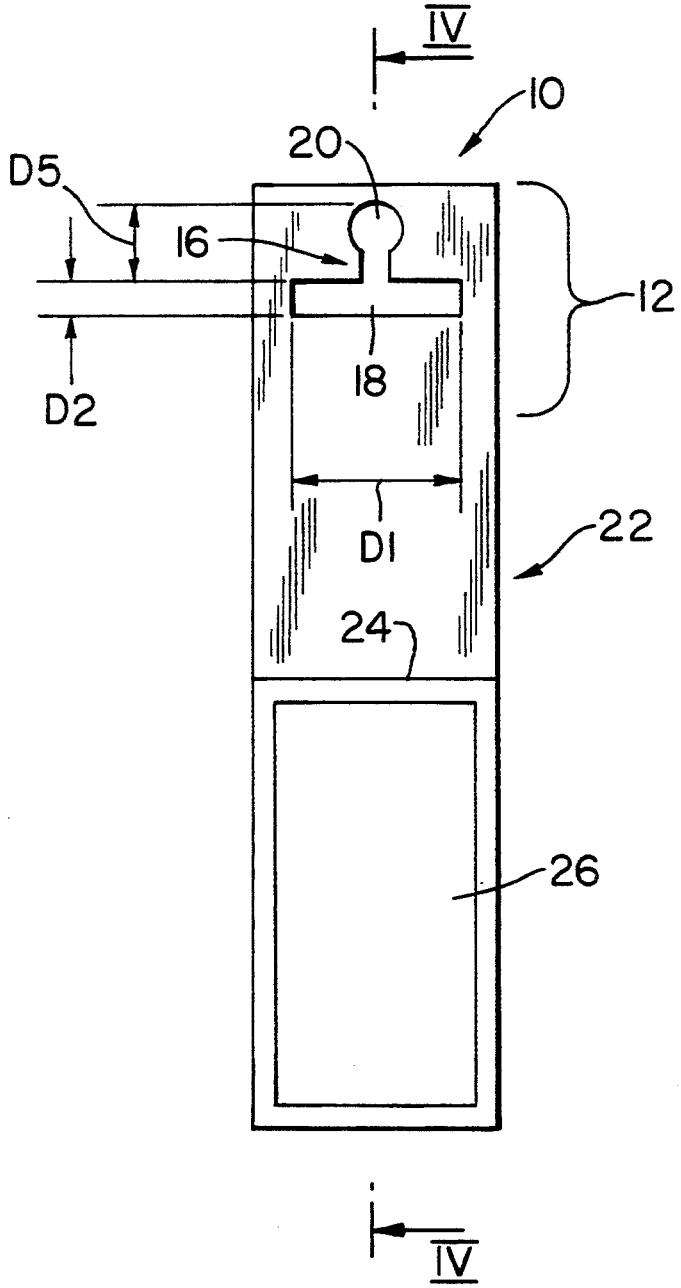
FIG. 3 is a front elevation of the second hanger of the hanger composite of the invention.
Figure 4:
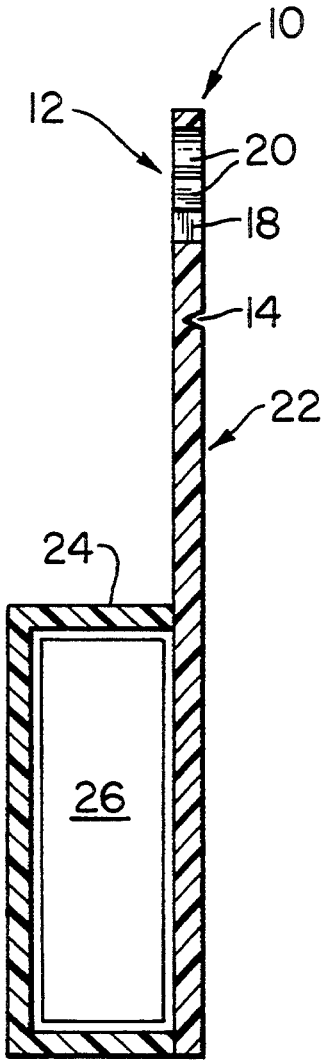
FIG. 4 is a cross-sectional view of the FIG. 3 hanger as would be seen from plane IV—IV of FIG. 3.

Referring to FIGS. 3 and 4, hanger 10 is comprised of an elongate synthetic plastic body and has an upper portion 12 with a rearside fold line 14 and an opening 16 having a first part 18 and a second part 20.

Lower portion 22 of hanger 10 is continuous with upper portion 12 and supports hollow shell 24, preferably heat sealed thereto, to define a compartment. Article 26 is shown in the compartment and may be a wristwatch or the like. The compartment and fold line 14 are on respective opposite sides of hanger 12 for purposes below discussed in connection with FIG. 5.

Figure 1:
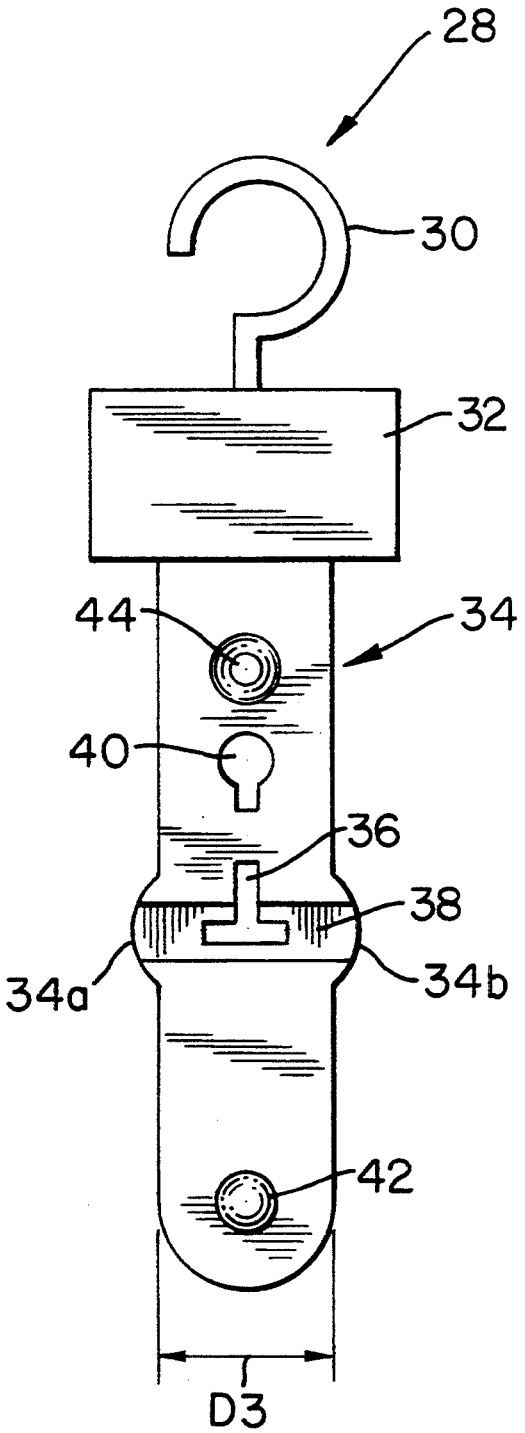
FIG. 1 (PRIOR ART)
FIG. 1 is a front elevation of one hanger of the hanger composite of the invention.
Figure 2:
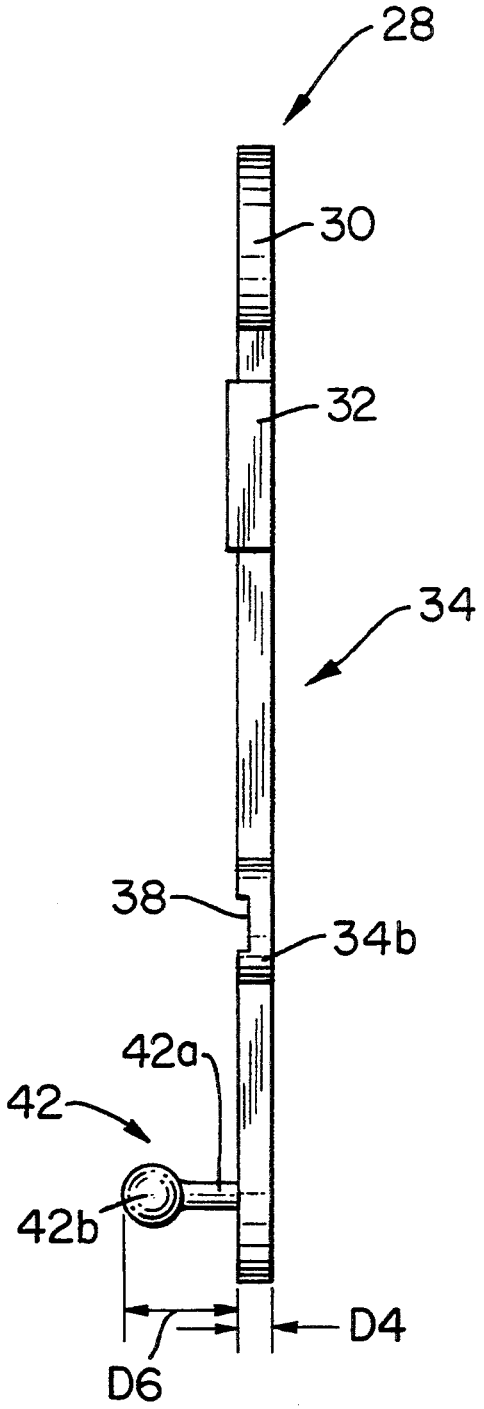
FIG. 2 (PRIOR ART)
FIG. 2 is a right side elevation of the FIG. 1 hanger.

Turning to FIGS. 1 and 2, known folding tail belt hanger 28 is an elongate synthetic plastic body having a hook portion 30, a logo/size display portion 32 and a tail portion 34. The tail portion includes belt buckle prong receiving opening 36 at fold line 38 and belt buckle stud receiving opening 40.

At its free end, tail portion has projection 42 extending outwardly thereof comprised of shank **42*a* and ball 42*b*. A latching opening 44 is adapted to receive projection 42 on folding of the tail portion, following insertion thereof through a belt buckle frame in the case of hanging a belt having a buckle with a prong. In the case of hanging a belt having a buckle with a stud, the tail portion is folded and projection 42 inserted in opening 44, with the stud then inserted and retained in opening 40**.

To enable assembly of hanger 10 with hanger 28, applicants configure opening 16 in hanger 10 complemental to the cross-section of the free end of tail portion 34 of hanger 28. Thus, hanger 10 is selected to have transverse and height dimensions D1 and D2 in FIG. 1 respectively in excess of the transverse dimension D3 and thickness D4 of tail portion 34 as shown in FIGS. 3 and 4, such that the tail portion can pass through hanger 10. Also, part 20 of opening 16 is selected to have a dimension D5 (FIG. 1) which is somewhat larger than projection dimension D6 (FIG. 2) such that projection 42 can pass through hanger 10.

Figure 5:
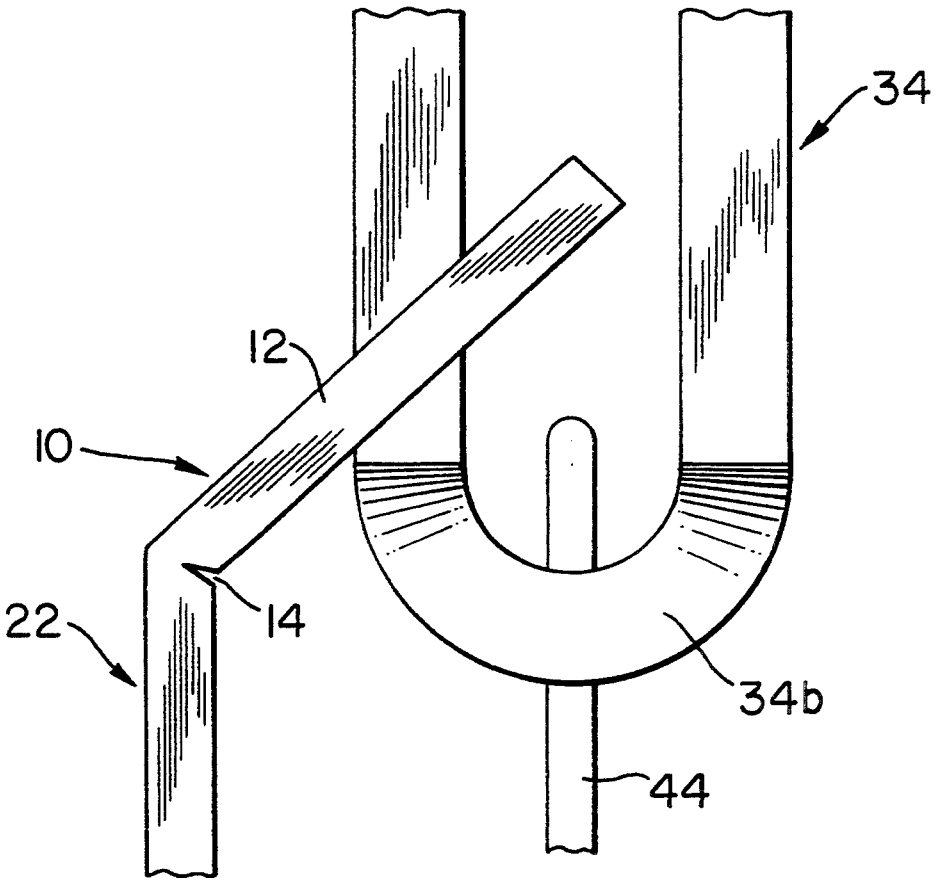
FIG. 5 is an enlarged, partial side elevation of the assembled hanger composite of the invention.

Referring to FIG. 5, it depicts in an enlarged and partial manner the assembly of the first and second hangers of the hanger composite of the invention. In the case of a prong-type buckle belt, the assembly is reached in a first step by practice in accordance with the first above referenced folding tail belt hanger patent, i.e., by inserting the tail portion of hanger 28 through the frame of the buckle and inserting the prong, noted in FIG. 5 by reference numeral 44, into opening 36. Then, the tail portion is passed through hanger 10, facilitated by the above noted dimensions, to the point at which it abuts marginal arcuate portions 34*a* and 34*b* (FIG. 1) of the tail portion. This configuration of the tail portion disposes hanger 10 distal from the belt buckle prong receiving opening, as is seen particularly in FIG. 5. The folding tail hanger is now secured by forcing projection 42 through latch opening 44 and portion 22 of hanger 10 is bent about fold line 14 such that portion 22 and compartment 24 may assume a vertical disposition parallel to the belt being hung.

In the case of hanging a stud buckle belt, the above step of assembling hanger 10 with hanger 28 is first practiced and the folding tail is secured. Then the stud is then passed through opening 40 (FIG. 1).

By way of summary and introduction to the ensuing claims, the invention will be seen to provide a hanger composite including a first hanger having a hook portion for releasable securement to a display rod and an elongate foldable tail portion, the tail portion defining a latching opening therethrough and a projection extending outwardly of the tail portion to a given extent for latching disposition in the latching opening, and a second hanger assembled with the first hanger and defining a compartment for containment of an article, the second hanger having an opening therethrough configured complementally with the tail portion of the first hanger and enabling the assembly of the first and second hangers. In its particularly preferred embodiment, the invention will be seen to provide a hanger composite including a first hanger having a hook portion for releasable securement to a display rod and an elongate foldable tail portion of a given transverse dimension, the tail portion defining a latching opening therethrough and a projection extending outwardly of the tail portion to a given extent for latching disposition in the latching opening and a second hanger of transverse dimension exceeding the given transverse dimension of the first hanger and defining an aperture therein having a first part of dimension corresponding with the given transverse dimension of the tail portion and a second part contiguous with the first part and being of dimension corresponding with the given extent of the projection of the tail portion, whereby the second hanger can be assembled with the tail portion by passage of the tail portion through the aperture and by folding of the tail portion and placement of the projection of the tail portion in the latching opening thereof.

The second hanger is elongate, the aperture therein being disposed adjacent a first end thereof, the second hanger defining a compartment longitudinally spaced from the aperture for containment of an article to be displayed.

The first hanger includes a belt buckle prong receiving opening at a location of folding of the tail portion and a belt buckle stud receiving opening in the tail portion.

Various changes to the particularly disclosed embodiments systems and methods may evidently be introduced without departing from the invention. For example, while the invention provides in the foregoing an assembly with the article in place in the compartment, i.e., the promotional article and hanger being fully assembled through heat sealing of a shell onto the rearward facing member, with the article in place prior to the heat sealing. The invention contemplates, on the other hand, a compartment which is receptive to the article at any point in time and then closable. By way of example, the compartment may have an upper shell lid which is openable to receive the article with the lid and lower portion 22 defining locking structure as discussed for the locking of the tail portion following folding thereof. Accordingly, it is to be appreciated that the particularly discussed and depicted preferred embodiments and practices of the invention are intended in an illustrative and not in a limiting sense. The true spirit and scope of the invention are set forth in the ensuing claims.

What is claimed is:

1. A hanger composite including:

(a) a first hanger having a hook portion for releasable securement to a display rod and an elongate foldable tail portion, said tail portion defining a latching opening therethrough and a projection extending outwardly of said tail portion to a given extent for latching disposition in said latching opening; and (b) a second hanger assembled with said first hanger and defining a compartment for containment of an article, said second hanger having an opening therethrough configured complementally with said tail portion of said first hanger and enabling the assembly of said first and second hangers.

2. The invention claimed in claim 1 wherein said first hanger defines a belt buckle prong receiving opening in said tail portion, said tail portion being configured to dispose said second hanger distal from said belt buckle prong receiving opening.

3. The invention claimed in claim 1 wherein said second hanger defines a fold line aside said second hanger opening.

4. The invention claimed in claim 3 wherein said second hanger fold line is disposed on a side of said second hanger opposite a side on which said compartment is disposed.

5. A hanger composite including:

(a) a first hanger having a hook portion for releasable securement to a display rod and an elongate foldable tail portion of a given transverse dimension, said tail portion defining a latching opening therethrough and a projection extending outwardly of said tail portion to a given extent for latching disposition in said latching opening; and (b) a second hanger of transverse dimension exceeding said given transverse dimension of said first hanger and defining an aperture therein having a first part of dimension corresponding with the given transverse dimension of said tail portion and a second part contiguous with said first part and being of dimension corresponding with said given extent of said projection of said tail portion, whereby said second hanger can be assembled with said tail portion by passage of said tail portion through said aperture and by folding of said tail portion and placement of said projection of said tail portion in said latching opening thereof.

6. The hanger composite claimed in claim 5 wherein said second hanger is elongate, said aperture therein being disposed adjacent a first end thereof, said second hanger defining a compartment longitudinally spaced from said aperture for containment of an article to be displayed.

7. The hanger composite claimed in claim 5 wherein said first hanger includes a belt buckle prong receiving opening at a location of folding of said tail portion.

8. The hanger composite claimed in claim 7 wherein said second hanger is elongate, said aperture therein being disposed adjacent a first end thereof, said second hanger defining a compartment longitudinally spaced from said aperture for containment of an article to be displayed.

9. The hanger claimed in claim 8 wherein said first hanger includes a belt buckle stud receiving opening in said tail portion.

10. The hanger claimed in claim 5 wherein said first hanger includes a belt buckle stud receiving opening in said tail portion.

11. The hanger composite claimed in claim 10 wherein said second hanger is elongate, said aperture therein being disposed adjacent a first end thereof, said second hanger defining a compartment longitudinally spaced from said aperture for containment of an article to be displayed.

12. In combination:

(a) a hanger composite including:

(I) a first hanger having a hook portion for releasable securement to a display rod and an elongate foldable tail portion of a given transverse dimension, said tail portion defining a belt buckle prong receiving slot at a fold location therein, a latching opening therethrough and a projection extending outwardly of said tail portion to a given extent for latching disposition in said latching opening; and (II) a second hanger of transverse dimension exceeding said given transverse dimension of said first hanger and defining an aperture therein having a first part of dimension corresponding with the given transverse dimension of said tail portion and a second part contiguous with said first part and being of dimension corresponding with said given extent of said projection of said tail portion, said second hanger being assembled with said tail portion by passage of said tail portion through said aperture and by folding of said tail portion and placement of said projection of said tail portion in said latching opening thereof; and (b) a belt having buckle with a frame and a prong, said frame being disposed within the fold of said tail portion and said prong disposed in said belt buckle prong receiving slot.

13. The invention claimed in claim 12 wherein said second hanger is elongate, said aperture therein being disposed adjacent a first end thereof, said second hanger defining a compartment longitudinally spaced from said aperture and containing an article to be displayed.

14. In combination:

(a) a hanger composite including:

(I) a first hanger having a hook portion for releasable securement to a display rod and an elongate foldable tail portion of a given transverse dimension, said tail portion defining a belt buckle stud receiving slot, a latching opening therethrough and a projection extending outwardly of said tail portion to a given extent for latching disposition in said latching opening; and (II) a second hanger of transverse dimension exceeding said given transverse dimension of said first hanger and defining an aperture therein having a first part of dimension corresponding with the given transverse dimension of said tail portion and a second part contiguous with said first part and being of dimension corresponding with said given extent of said projection of said tail portion, said second hanger being assembled with said tail portion by passage of said tail portion through said aperture and by folding of said tail portion and placement of said projection of said tail portion in said latching opening thereof; and (b) a belt having buckle with a stud disposed in said belt buckle stud receiving slot.

15. The invention claimed in claim 14 wherein said second hanger is elongate, said aperture therein being disposed adjacent a first end thereof, said second hanger defining a compartment longitudinally spaced from said aperture and containing an article to be displayed.

* * * * *